US005521889A

United States Patent [19]

Scarinzi et al.

[11] Patent Number: 5,521,889

[45] Date of Patent: May 28, 1996

[54] WATCH HAVING A FLUID-TIGHT ROTARY CRYSTAL OR CRYSTAL-BEZEL UNIT

[75] Inventors: Renato Scarinzi, Bienne; Alfred Joss, Romont; Hanspeter Grädel, Brügg, all of Switzerland

[73] Assignee: Walca SA, Bienne, Switzerland

[21] Appl. No.: 315,945

[22] Filed: Sep. 30, 1994

[51] Int. Cl.[6] ..... G04B 37/00

[52] U.S. Cl. ..... 368/294; 368/291

[58] Field of Search ..... 368/294–296, 368/291–293

[56] References Cited

U.S. PATENT DOCUMENTS

| | | | |
|---|---|---|---|
| 3,706,198 | 12/1972 | Fukushima | 368/291 |
| 3,744,238 | 7/1973 | Hirabayashi et al. | 368/292 |
| 3,828,549 | 8/1974 | Nozawa | 368/294 |
| 3,934,402 | 1/1976 | Fujimori | 368/294 |
| 4,067,186 | 1/1978 | Grohoski et al. . | |
| 4,110,970 | 9/1978 | Funazawa et al. | 368/291 |
| 4,157,646 | 6/1979 | Wuthrich . | |
| 4,234,948 | 11/1980 | Maekawa et al. | 368/291 |
| 4,363,555 | 12/1982 | Finger | 368/291 |
| 4,397,566 | 8/1983 | Lederrey . | |
| 4,479,724 | 10/1984 | Matsumoto et al. | 368/291 |
| 5,154,977 | 10/1992 | Saito . | |

FOREIGN PATENT DOCUMENTS

| | | |
|---|---|---|
| 0310007 | 4/1989 | European Pat. Off. . |
| 0535625 | 4/1993 | European Pat. Off. . |
| 6808162 | 11/1968 | Germany . |
| 504033 | 11/1970 | Switzerland . |
| 590512 | 5/1977 | Switzerland . |
| 631592 | 8/1982 | Switzerland . |
| 662922G | 11/1987 | Switzerland . |
| 681127G | 1/1993 | Switzerland . |
| WO89/07287 | 8/1989 | WIPO . |

*Primary Examiner*—Bernard Roskoski
*Attorney, Agent, or Firm*—Oliff & Berridge

[57] ABSTRACT

The crystal-bezel unit (1, 20) allows dismantling of the timepiece from above and can be moved rotatingly relative to a caseband (4), where a joining gasket (10) including at least one active portion is disposed between the crystal-bezel unit and the caseband. An optional fixing means (20) holds the fixed and rotating units together.

20 Claims, 5 Drawing Sheets

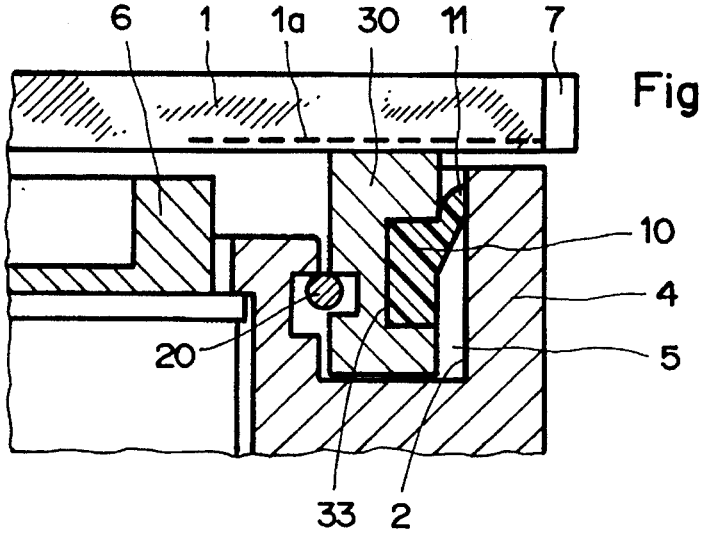
Fig. 7a
Fig. 7b
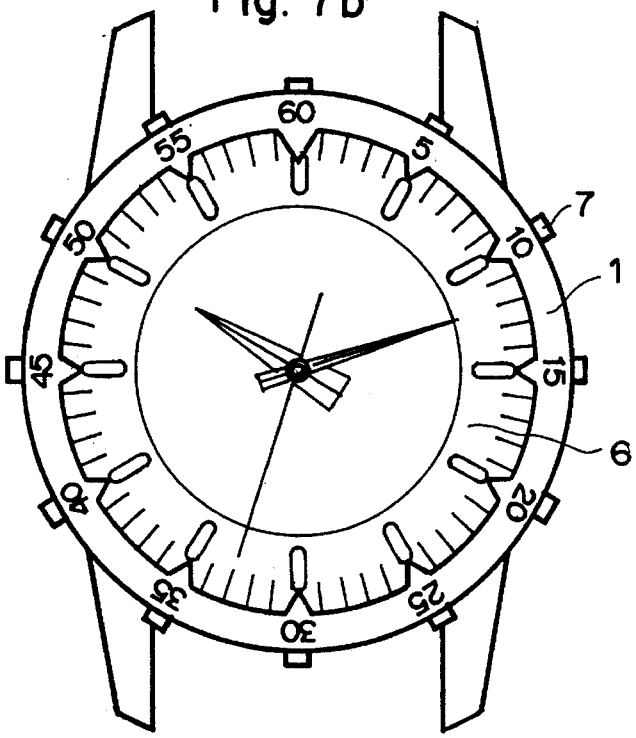
Fig. 8
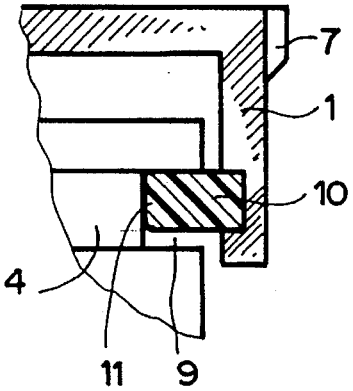

WATCH HAVING A FLUID-TIGHT ROTARY CRYSTAL OR CRYSTAL-BEZEL UNIT

This invention relates to timepieces, and more particularly to a timepiece of the type having a crystal-bezel unit allowing dismantling of this unit from above and capable of being moved rotatingly relative to the caseband, a joining gasket being disposed between the crystal-bezel unit and the caseband in such a way that the assembly formed by the crystal-bezel unit, the joining gasket, and the caseband is fluid-tight, the joining gasket being fixed to one of the fixed or rotating parts.

Prior art watches having a fluid-tight rotary crystal comprise a large number of parts, and their design is complex.

Swiss Patent No. 681,127 to Werthanor SA represents a typical example of the design used to obtain effective fluid-tightness. A conventional packing gasket is disposed between the bezel and the caseband; a casing-ring disposed within the caseband permits the whole to be fixed. The best known means of allowing a design of this type to be simplified and/or a thinner watch to be produced consists in eliminating the fluid-tightness, with all the drawbacks that involves.

Moreover, a watch having an exterior rotating bezel of the prior-art type is frequently subject to premature deterioration because of the presence of liquid or solid contaminants entering between the fixed part and the turning part. Rotation thus becomes difficult, sometimes even impossible.

Swiss Patent No. 662,922 describes a timepiece having a fluid-tight rotary crystal-bezel unit including features of the type first mentioned.

It is therefore an object of this invention to provide an improved timepiece having a fluid-tight rotary crystal, the design of which is simplified.

To this end, in the timepiece according to the present invention, of the type initially mentioned, the joining gasket includes at least one active portion formed by an extension of pointed cross-section oriented in a specific direction relative to the main body forming the joining gasket, and the crystal-bezel unit can move axially relative to the caseband, especially with a view to carrying out dismantling from above.

The invention makes it possible to obtain a watch having a fluid-tight rotary crystal, the design of which is considerably simplified since merely a joining gasket and possibly a fixing means, disposed at the level of the caseband/bezel interface, suffice to allow both rotation and fluid-tightness. Furthermore, in a particular embodiment, either a cemented or soldered crystal/bezel unit or else a combined crystal-and-bezel can even be used, thus simplifying the design of the watch even more.

Thus, with the invention, there can be a rim-to-rim crystal, offering the possibility of mounting from above, and hence of having a combined caseband-and-back. Crystals of various shapes may be used, e.g., curved or not. With a rim-to-rim crystal including the signs usually disposed on the bezel, similar functions are obtained with improved reading characteristics and precision. The rotating rim-to-rim crystal offers numerous possibilities of functions such as divers' watches, slide rules, etc. What is more, the simplified concept and the optimization of the number of parts permit thinner cases to be produced as compared with prior art fluid-tight watches.

Owing to the presence of the joining gasket, the invention permits the internal parts to be protected from corrosion, damage, or other forms of wear and tear by preventing any liquid or solid contaminant (particles, dust, etc.) from entering the case. The means of locking the bezel (a snap, click, or the like) is thus well protected.

Preferred embodiments of the invention will now be described in detail, with reference to the accompanying drawings, in which.

FIG. 7*a* is a partial sectional view of a watch equipped with a crystal according to the invention;

FIG. 7*b* is a top plan view of the watch of FIG. 7*a;*

Figure 9:
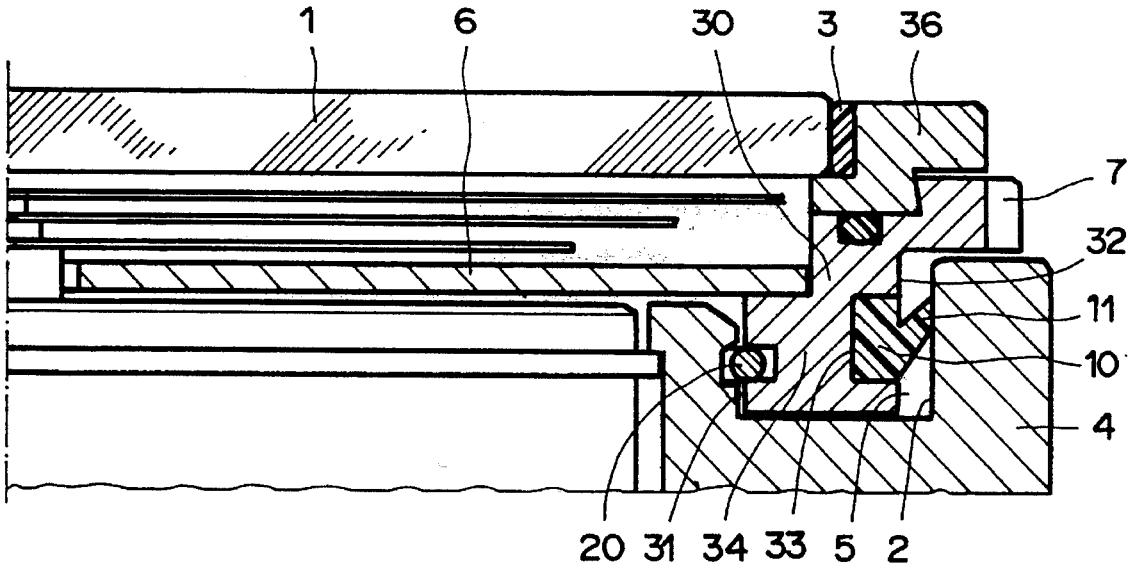

FIG. 8 is a partial sectional view of a watch equipped with a fluid-tight rotary crystal in a third embodiment of the invention where the crystal is extended over the side of the caseband; and FIG. 9 is a partial sectional view of a watch equipped with a fluid-tight rotary crystal in a fourth embodiment of the invention where the dial rotates with the crystal and the bezel.

Figure 1:
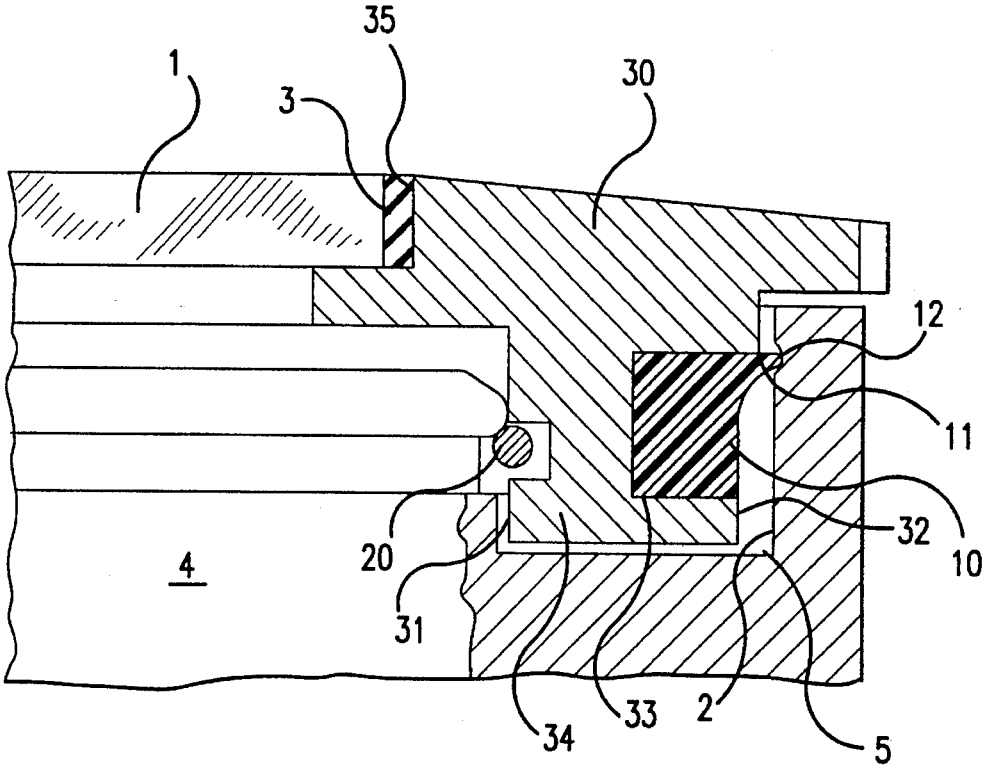
FIG. 1 is a partial sectional view of a watch equipped with a fluid-tight rotary crystal in a first embodiment of the invention where the joining gasket includes only a single active portion.
Figure 2A:
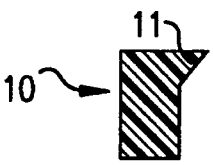
FIG. 2 is a group of cross-sectional views illustrating examples (a to j) of possible shapes for the joining gasket used within the scope of the invention.
Figure 2B:
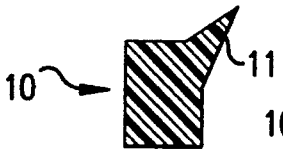
Figure 2C:
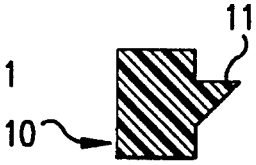
Figure 2D:
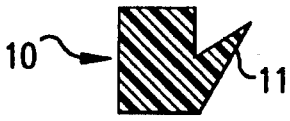
Figure 2E:
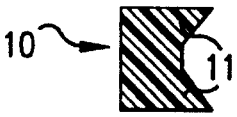
Figure 2F:
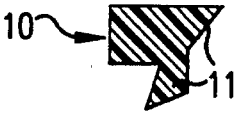
Figure 2G:
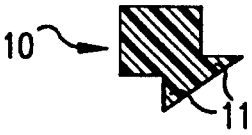
Figure 2H:
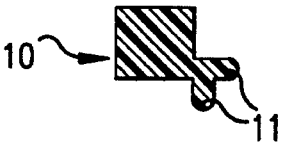
Figure 2I:
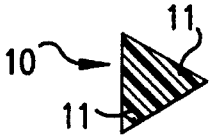
Figure 2J:
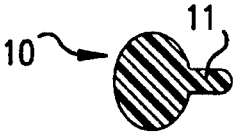

In a first embodiment illustrated in FIG. 1, the inventive watch comprises a crystal 1 of a standard type, e.g., made of mineral glass, plexiglass, sapphire, or some other transparent material, fixed to a bezel 30 with a gasket 3 interposed between the periphery of crystal 1 and a support surface 35 of bezel 30. A portion 34 of bezel 30 enters a recess 5 in the top of a caseband 4 at the periphery thereof. Bezel 30 is secured to caseband 4 by a fixing means 20, e.g., a conventional side or polygonal wire spring. As in prior art watches, this fixing means may be removable or permanent. Fixing means 20 is preferably disposed along the inner face 31 of bezel 30, as shown in FIG. 1. However, it may prove just as advantageous for it to be disposed along the outer face 32 of bezel 30, depending upon the space available on one or the other of these faces.

A gasket 10 is disposed in a groove 33 in outer face 32 of bezel 30. Gasket 10 is shaped so that an active portion 11 protrudes from face 32. This gasket may be made of various materials but should preferably be flexible enough to permit good positioning of active portion 11 and the rotary movement between bezel 30 and caseband 4 and must be rigid enough to offer good support between those two parts. Conclusive tests have been carried out with joining gaskets 10 made of the elastomer of the type "NBR 75" Shore hardness. Any other material answering these criteria, particularly of the elastomer family, may be used as well, with different coefficients of hardness.

Active portion 11 is held in a snug fit by the adjacent wall 2 of caseband 4. Such a fit yields a fluid-tight joint between the turning part and the fixed part of the watch. In a modification, a recess 12, which may take any of a number of shapes, is made in the adjacent wall 2 to serve as a female active portion. The male active portion 11 of gasket 10 enters recess 12 wholly or in part in order to perfect the fluid-tightness owing to a greater contact surface, while at the same time giving a more effective hold.

The joining gasket may take a great many shapes, be mounted in a great many orientations, and be fixed either to the bezel, the caseband, or the crystal. Moreover, the fixing means may be integrated in the joining gasket, further simplifying the design and the assembly. This gasket also offers the advantage of being usable with various materials, such as steel, brass, plastics, precious metals, etc. It may be fixed in a seat by gripping, be cemented, vulcanized, soldered, etc. By varying the shape, especially the width of active portion 11, as well as the grip of the snug fit, it is possible to optimize certain mechanical characteristics such as the friction, and thereby to optimize the force necessary to turn the crystal and/or the bezel.

The watch described above is therefore completely fluid-tight positively and negatively: overpressure outside the case caused by high atmospheric or liquid pressure has no effect on the interior of the case, the internal and external pressures remaining substantially the same and the media remaining separate; similarly, in the event of under-pressure outside the case, e.g., at a high altitude, the interior pressure remains substantially unchanged. Fluid-tightness is ensured whatever the angular position of the bezel and/or the crystal relative to the caseband. Furthermore, the presence of joining gasket 10 makes possible a substantially vertical movement between bezel 30 and caseband 4, with or without rotation of the bezel, since these two movements can be completely independent of one another. According to the configuration adopted, the force exerted by the outside pressure, possibly combined with a slight vertical displacement, confers an optimum positioning on active portion 11, causing the fluid- tightness to increase as the pressure increases. Thus, greater levels of fluid-tightness are obtained than with prior art fluid- tight watches. This phenomenon allows a joining gasket of the type illustrated in example d of FIG. 2 to attain levels of fluid-tightness greater than 5 atmospheres.

FIG. 2 illustrates various advantageous cross-sections for joining gasket 10. Examples 2*a* to 2*d* and 2*j* have a single active portion, while 2*e* to 2*i* have two active portions, one of which exerts its effect upon the bottom wall of recess 5, giving better protection against any infiltration into the case. The active portion exerting its effect upon the bottom of recess 5 can serve both to take up the vertical play between the fixed part and the rotary part of the watch, while at the same time acting upon the fluid-tightness, particularly to prevent decompression of the case when the watch is in a low-pressure environment.

Many other shapes may be used, with one, two, three, or more active portions, disposed according to countless possibilities. What is more, as will be described below in a second embodiment of the invention, these different types of gasket may be used in conjunction with the fixing means, the latter being integrated in the gasket or formed next to it.

Figure 3:
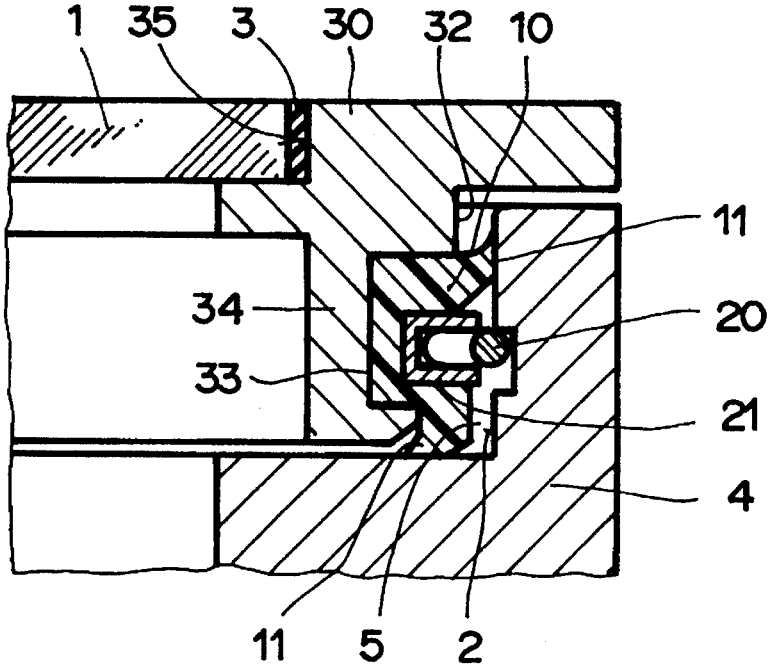
FIG. 3 is a partial sectional view of a watch equipped with a fluid-tight rotary crystal in a second embodiment of the invention where the joining gasket includes more than one active portion.
Figure 6:
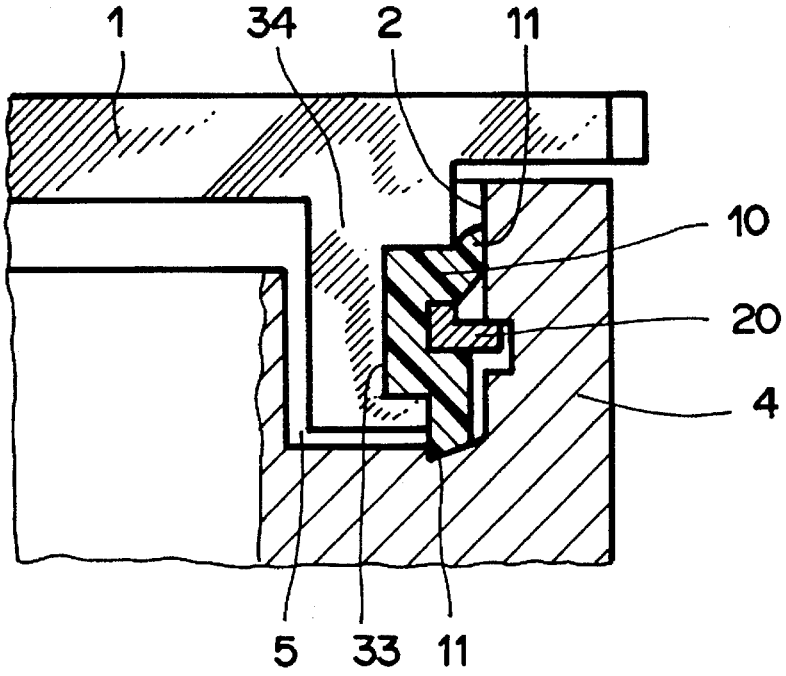
FIG. 6 is a partial sectional view of a watch equipped with a fluid-tight rotary crystal in a modification of the second embodiment with a rim-to-rim crystal, the crystal-bezel unit forming a single piece.

FIG. 3 illustrates this second embodiment. In this drawing figure, those elements which are of the same nature and play the same part as the corresponding elements in FIG. 1 are designated by the same reference numerals. In this embodiment, bezel 30 is held by a fixing means 20 disposed nearer the outer face 32 of the projecting portion 34 of bezel 30. In FIG. 3, fixing means 20 is held by a fixing ring 21 disposed in gasket 10. Means 20 is preferably a conventional side or polygonal wire-spring but may also be different, such as shown in FIG. 6, where a rod disposed partially in gasket 10 performs the holding function. In one or the other of the modifications, fixing means 20 preferably comprises a portion which enters a groove in the adjacent wall, thus ensuring vertical support. Various modifications permit the fixing means to be integrated in gasket 10. The fixing ring 20 illustrated in FIG. 3 is preferably a steel ring disposed in the gasket. This ring may obviously be made of some other rigid material, e.g., a carbon-fiber-base composition or the like. Owing to the integration of the holding means into the gasket, the design of bezel 30 and its assembly in the caseband are simplified. FIG. 3 also shows an example of gasket 10 with two active portions. The snug fits, both lateral and vertical, ensure uniform contact between the gasket and the concomitant surface along the entire periphery.

Figure 4:
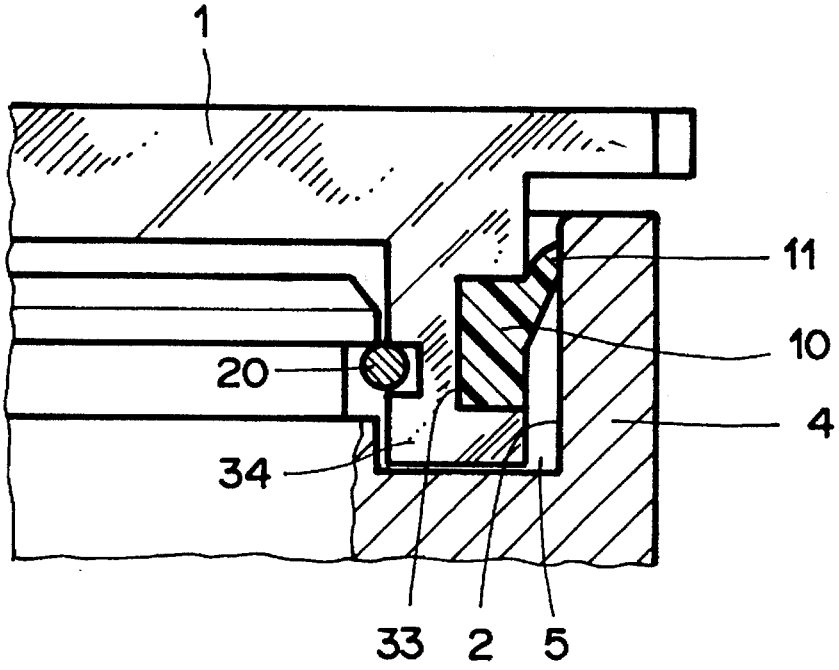
FIG. 4 is a partial sectional view of a watch equipped with a fluid-tight rotary crystal in a modification of the first embodiment with a rim-to-rim crystal, the crystal-bezel unit forming a single piece.
Figure 5:
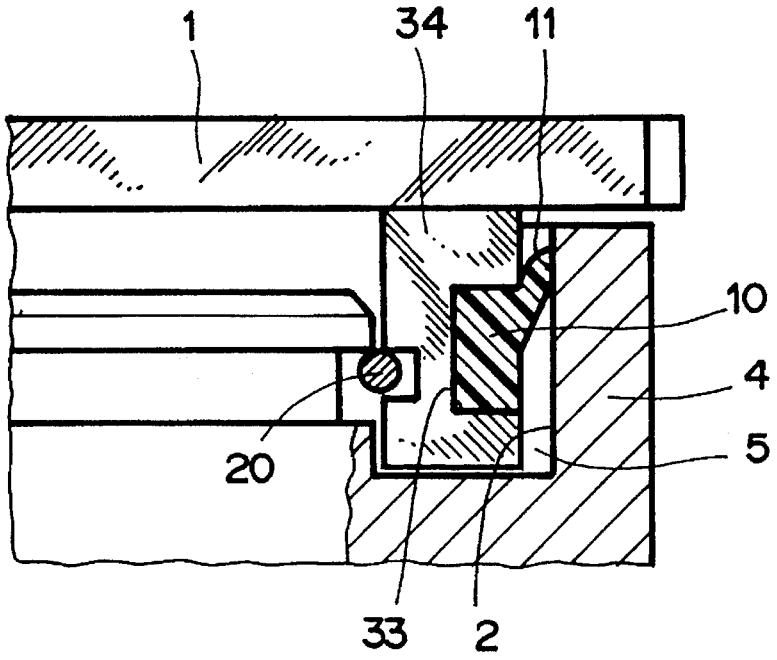
FIG. 5 is a partial sectional view of a watch equipped with a fluid-tight rotary crystal in another modification of the first embodiment with a rim-to-rim crystal and bezel.

In another modification of the first embodiment, the crystal-bezel unit 1/30 is replaced by a combination crystal, a portion of which is shaped to form a bezel (FIGS. 4 and 6), or else by a crystal extending over the whole top of the watch with a bezel portion made of glass, steel, titanium, or other material, cemented or soldered under the lower surface of the crystal (FIGS. 5 and 7*a*).

The inventive watch may include a locking means for holding the crystal and/or the bezel in a predetermined position. Such means have already been proposed and include, for example, notch, tooth, or click mechanisms, disposed beneath the bezel, for instance.

FIGS. 7*a* and 7*b* illustrate an example of a watch according to the invention. Crystal 1 includes the indicia 1*a* (figures, guide-marks, etc.) usually imprinted on the bezel. The indicia on the crystal may be made by any known means, e.g., by metallization. The rim-to-rim crystal 1 is cemented to bezel 30. Dial 6 includes a raised portion along the edge on which the hour-symbols and other guide-marks are disposed, selected according to the type of watch. The crystal is easily moved angularly owing to spurs 7 disposed at the periphery. Spurs 7 may obviously be replaced by knurling made directly on crystal 1. It may be seen in FIG. 7*a* and 7*b* that it is easy to superimpose the indications on crystal 1 and dial 6, whereby very diverse characteristics of use are conferred: easier reading, greater precision, substantial facility for carrying out certain functions such as those of a slide rule or the like.

FIG. 8 shows a third embodiment in which a rim-to-rim crystal 1 is bent down over the outside of caseband 4 to form a cover. Gasket 10, fixed to the inside wall of crystal 1, enters an outer fixing groove 9 in the periphery of caseband 4 so as to ensure the support and rotation of crystal 1, as well as the fluid-tightness of the assembly.

FIG. 9 depicts a fourth embodiment of the invention in which dial 6 turns with crystal 1 and bezel 30. Dial 6 is disposed on a shoulder of rotary bezel 30. The assembly is closed from above by means of crystal 1 fixed to bezel 30 via an inset bezel 36 disposed fluid-tightly on bezel 30. This embodiment is particularly advantageous since it permits carrying out a large number of combinations in which the indicia and markings may be disposed on crystal 1 and/or on dial 6 and/or on caseband 4. Thus, it is possible to produce, for instance, a "time zone" watch where the guide-marks indicating the hour, preferably disposed on dial 6, may be displaced by simple rotation of the crystal-bezel-dial unit in order to make them correspond to the time-zone indications disposed on caseband 4. In this way, it is possible to read the time of any time zone without changing the position of the hands. The necessary manipulation is quick and easy.

What is claimed is:

1. A timepiece of the type having a dial, a caseband, a crystal-bezel unit capable of being dismantled from above and moved rotatingly relative to said caseband, and a joining gasket disposed between said crystal-bezel unit and said caseband in such a way that the assembly formed by said crystal-bezel unit, said gasket, and said caseband is fluid-tight, wherein the improvement comprises:

at least one active portion of said gasket formed by an extension thereof of pointed cross-section oriented in a predetermined direction relative to the main body of said gasket, said crystal-bezel unit comprising a groove, and being adapted to move axially relative to said caseband for dismantling from above, wherein said gasket is disposed in said groove with said at least one active portion extending from the groove, said at least one active portion being radially and axially compressed during assembly and dismantling of said crystal-bezel unit.

2. The timepiece of claim 1, wherein said active portion of said gasket co-operates with an adjacent wall of said caseband in order to obtain a snug fit.

3. The timepiece of claim 1, wherein said active portion is oriented substantially radially.

4. The timepiece of claim 1, wherein said active portion is oriented substantially axially.

5. The timepiece of claim 4, wherein an axial displacement of said crystal-bezel unit whereby said crystal moves closer to said dial brings about an increase in the axial force on said active portion oriented substantially axially.

6. The timepiece of claim 4, wherein an axial displacement of said crystal-bezel unit is a function of the force exerted by the ambient pressure to which said timepiece is subjected.

7. The timepiece of claim 1, further comprising a fixing means securing said crystal-bezel unit to said caseband.

8. The timepiece of claim 1, wherein said crystal-bezel unit is secured to said caseband via said gasket.

9. The timepiece of claim 7, wherein said fixing means is disposed along the inner face of said bezel.

10. The timepiece of claim 7, wherein said fixing means is integrated in said gasket.

11. The timepiece of claim 7, wherein the outer face of said bezel includes a groove, said gasket being disposed in said groove.

12. The timepiece of claim 1 wherein the underside of said crystal is fixed to the top of said bezel.

13. The timepiece of claim 1 wherein said dial is fixed to said crystal-bezel unit so as to be able to turn simultaneously therewith.

14. The timepiece of claim 1 wherein said crystal-bezel unit is made in one piece.

15. The timepiece of claim 14, wherein said crystal is extended on the outside along a portion of the rim of said caseband, and in that a further joining gasket is disposed between the extension of said crystal and the rim of said caseband.

16. A timepiece comprising:

a dial;

a caseband;

a crystal-bezel unit capable of being dismantled from above and moved rotatingly relative to said caseband; and a joining gasket disposed between said crystal-bezel unit and said caseband in such a way that the assembly formed by said crystal-bezel unit, said gasket, and said caseband is fluid-tight, wherein the gasket comprises at least one active portion formed by an extension thereof of pointed cross-section oriented in a predetermined direction relative to the main body of said gasket, said crystal-bezel unit comprising a groove, and being adapted to move axially relative to said caseband for dismantling from above, wherein said at least one active portion of said gasket is disposed in said groove, and is radially and axially compressed when said crystal-bezel unit is axially moved relative to said caseband for assembly and dismantling.

17. The timepiece of claim 1, wherein the joining gasket is secured to a fixed part of the timepiece.

18. The timepiece of claim 1, wherein the joining gasket is secured to a rotating part of the timepiece.

19. The timepiece of claim 16, wherein the joining gasket is secured to a fixed part of the timepiece.

20. The timepiece of claim 16, wherein the joining gasket is secured to a rotating part of the timepiece.

* * * * *